US006190137B1

(12) United States Patent
Robbins et al.

(10) Patent No.: US 6,190,137 B1
(45) Date of Patent: Feb. 20, 2001

(54) REVERSIBLE, VARIABLE DISPLACEMENT COMPRESSOR

(75) Inventors: Elizabeth A. Robbins, Adrian; Raymond D. Howell, Clinton; Timothy Westcott, Clayton, all of MI (US)

(73) Assignee: Tecumseh Products Company, Tecumseh, MI (US)

( * ) Notice: Under 35 U.S.C. 154(b), the term of this patent shall be extended for 0 days.

(21) Appl. No.: 09/406,068

(22) Filed: Sep. 24, 1999

(51) Int. Cl.[7] ..... F04B 1/06
(52) U.S. Cl. ..... 417/221; 417/315; 92/13.3
(58) Field of Search ..... 417/315, 221; 92/13.3

(56) References Cited

U.S. PATENT DOCUMENTS

| | | | |
|---|---|---|---|
| 1,556,912 | 10/1925 | Canoose . | |
| 2,035,096 | 3/1936 | Schneider . | |
| 2,612,839 | 10/1952 | Denny . | |
| 3,010,339 | 11/1961 | Brock . | |
| 3,401,639 | 9/1968 | Schwertfeger et al. . | |
| 3,738,230 | 6/1973 | Censi . | |
| 3,796,523 | 3/1974 | Albrecht et al. . | |
| 4,143,995 | 3/1979 | Divisi . | |
| 4,236,874 | 12/1980 | Sisk . | |
| 4,245,966 | 1/1981 | Riffe | 417/539 |
| 4,248,053 | 2/1981 | Sisk | 62/158 |
| 4,261,228 | 4/1981 | Eagan, Sr. . | |
| 4,479,419 | 10/1984 | Wolfe . | |
| 4,494,447 | 1/1985 | Sisk . | |
| 4,682,532 | 7/1987 | Erlandson . | |
| 4,830,589 | 5/1989 | Pareja . | |
| 4,861,236 | 8/1989 | Kustes et al. . | |
| 5,199,857 | 4/1993 | Sanuki . | |
| 5,366,355 | 11/1994 | Patterson . | |
| 5,560,460 | 10/1996 | Ezawa . | |
| 5,609,127 | 3/1997 | Noplis . | |
| 6,092,993 * | 7/2000 | Young et al. | 417/315 |
| 6,099,259 * | 8/2000 | Monk et al. | 417/221 |

FOREIGN PATENT DOCUMENTS

| | | |
|---|---|---|
| 0 827 843 | 5/1981 | (SU) . |
| WO 99/09319 | 2/1999 | (WO) . |

* cited by examiner

*Primary Examiner*—Timothy S. Thorpe
*Assistant Examiner*—Cheryl J. Tyler
(74) *Attorney, Agent, or Firm*—Baker & Daniels

(57) ABSTRACT

A reciprocating piston compressor having at least one cylinder, a reciprocable piston disposed in the cylinder, a crankshaft rotatable in both a forward and a reverse direction, the crankshaft having a cylindrical eccentric portion, a latching member pivotally engaged with the crankshaft, a cam disposed about the crankshaft eccentric portion, the piston operatively connected to the cam, and a spring connected to one of the cam and the crankshaft, the position of the latching member influenced by the spring. The cam is rotatable about the crankshaft eccentric portion between a first cam position corresponding to a first piston stroke length during forward rotation of the crankshaft, and a second cam position corresponding to a second piston stroke length during reverse rotation of the crankshaft. In one of the first and second cam positions, the cam is rotatably locked to the crankshaft eccentric portion by the latching member.

20 Claims, 5 Drawing Sheets

REVERSIBLE, VARIABLE DISPLACEMENT COMPRESSOR

BACKGROUND OF THE INVENTION

The present invention pertains to reversible reciprocating piston machines, and particularly to reversible reciprocating piston compressors.

Reciprocating piston compressors, such as the compressor disclosed in U.S. Pat. No. 5,281,110, which is assigned to the present assignee, the disclosure of which is incorporated herein by reference, are generally of fixed displacement and powered by an rotating driving source which operates in a single direction. Also known in the art are reversible reciprocating piston compressors in which a piston has a first stroke length when driven by a crankshaft rotating in a first, forward direction, and a second stroke length when driven by the crankshaft rotating in a second, reverse direction, through use of an eccentric cam which rotates relative to the crankshaft between stops thereon corresponding to first and second angular cam positions which, in turn, correspond to the first and second stroke lengths. These reversible compressors provide the advantage of having one displacement when the crankshaft is rotated in the forward direction, and another displacement when the crankshaft is rotated in the reverse direction. Typical variable stroke, reversible drive compressors, however, do not provide means for positively maintaining the cam in the angular position corresponding to the greater stroke length during rotation of the crankshaft. If the cam is not continually maintained in this angular position during crankshaft rotation, the reexpansion of gas in the cylinder after the piston reaches top-dead-center (TDC) may force the piston away from its TDC position at such a speed that the cam may rotate relative to the crankshaft, separating the cam and crankshaft stops. The separation of these stops result in their subsequently slamming together as the rotating crankshaft catches up to the cam, causing considerable component stresses, adversely affecting durability, and producing undesirable noise.

U.S. patent application Ser. No. 09/099,013, filed Jun. 17, 1998, now U.S. Pat. No. 5,951,261, which is also assigned to the present assignee, the disclosure of which is also incorporated herein by reference, provides a means of preventing separation of the cam and crankshaft stops by locking the cam to the crankshaft in a particular angular position when the crankshaft rotates in one of two directions. According to that disclosure, under the influence of centrifugal force, a latching member comprising a pin is slidably extended from a radial bore provided in the eccentric crankpin into engagement with a mating bore provided in the cam. While locking the crankshaft and cam together, the latching pin is subjected to substantial shear forces which may lead to partial or complete failure of the pin. A more durable means for locking the cam and crankshaft stops together, to prevent their separation upon the reexpansion of gas in the cylinder after the piston reaches TDC is desirable.

SUMMARY OF THE INVENTION

The present invention addresses the durability concerns associated with the latching pin of the above-mentioned previous reversible, variable displacement compressor. Unlike that latching pin, which is longitudinally extended between the eccentric crankpin and cam interface, and subjected to substantial shear stresses during compressor operation to prevent separation of the cam and crankshaft stops, the present invention provides a latching member which is pivoted into its operative position. The pivoting latching member of the present invention is subjected to compressive stresses in preventing such separation, thereby providing a locking means of improved durability.

The present invention provides a reciprocating piston compressor including at least one cylinder, a reciprocable piston disposed in the cylinder, a crankshaft rotatable in both a forward and a reverse direction and having a cylindrical eccentric portion, a latching member pivotally engaged with the crankshaft, a cam disposed about the crankshaft eccentric portion, the piston operatively connected to the cam, and a spring connected to one of the cam and the crankshaft, the position of the latching member influenced by the spring. The cam is rotatable about the crankshaft eccentric portion between a first cam position corresponding to a first piston stroke length during forward rotation of the crankshaft, and a second cam position corresponding to a second piston stroke length during reverse rotation of the crankshaft. In one of the first and second cam positions, the cam is rotatably locked to the crankshaft eccentric portion by the latching member.

The present invention also provides a reciprocating piston compressor including at least one cylinder, a reciprocable piston disposed in the cylinder, a crankshaft rotatable in both a forward and a reverse direction and having a cylindrical eccentric portion, a latching member, and a cam disposed about the crankshaft eccentric portion, the piston operatively connected to the cam. The cam is rotatable about the crankshaft eccentric portion between a first cam position corresponding to a first piston stroke length during forward rotation of the crankshaft, and a second cam position corresponding to a second piston stroke length during reverse rotation of the crankshaft. Means are provided for placing the latching member under compression between the cam and the crankshaft in one of the first and second cam positions, thereby rotatably locking the cam to the crankshaft.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
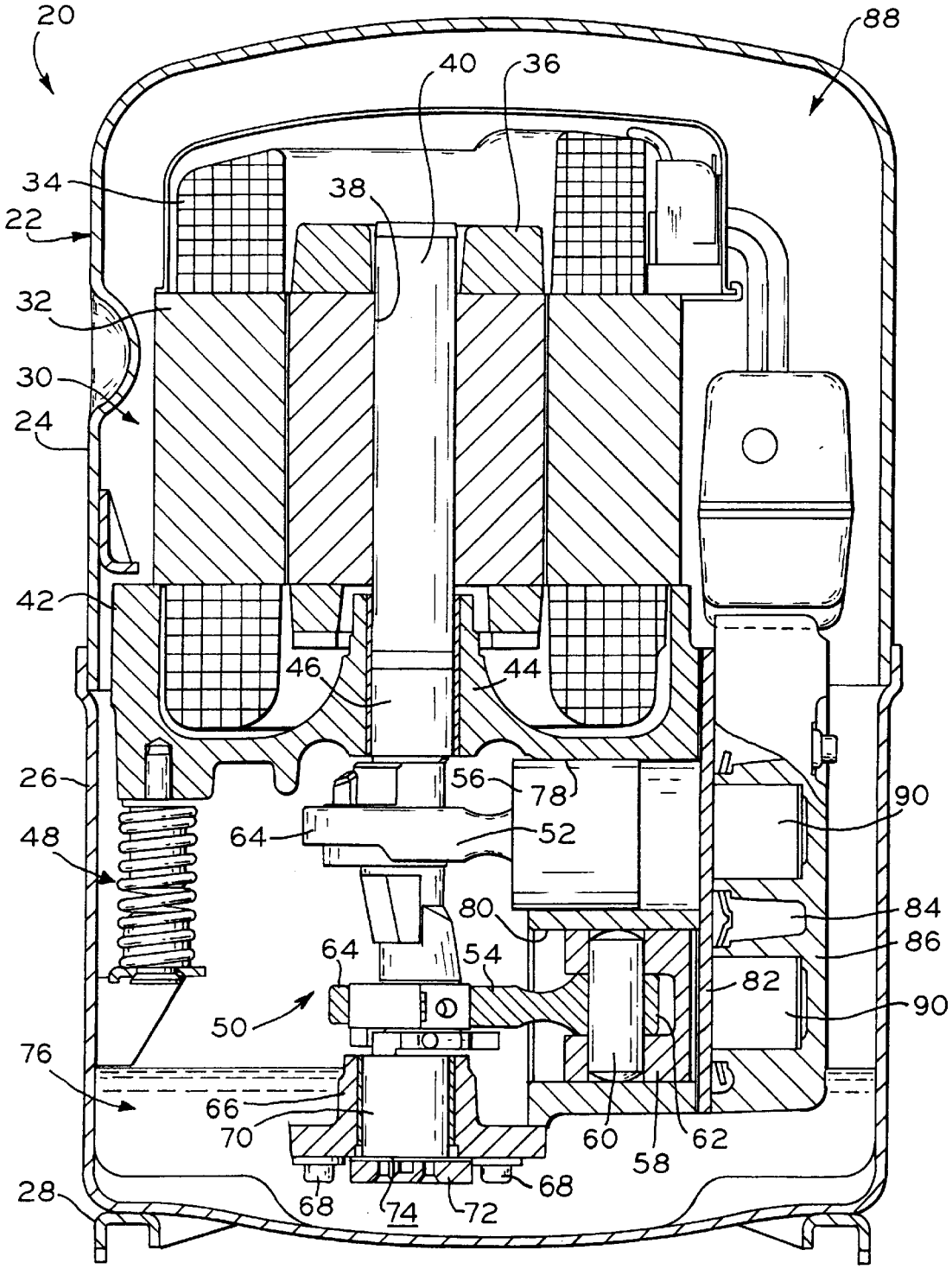
FIG. 1 is a sectional side view showing an embodiment of a compressor according to the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention, in one form, and such exemplification is not to be construed as limiting the scope of the invention in any manner.

DETAILED DESCRIPTION OF THE INVENTION

Referring to FIG. 1 there is shown compressor assembly 20, which is part of a refrigeration or air conditioning system (not shown). Compressor assembly 20 has housing 22 which is comprised of top portion 24 and bottom portion 26. The two housing portions are welded or bolted together. Mounting bracket 28 is attached to lower housing portion 26. Although compressor assembly 20 has a vertical crankshaft orientation, the scope of the present invention encompasses reversible compressors having a horizontal crankshaft orientation as well.

Located within hermetically sealed housing 22 is reversible electric motor assembly 30 having stator 32 provided with windings 34, and rotor 36 provided with central aperture 38 in which crankshaft 40 is secured by means of an interference fit. Windings 34 may comprise two individual windings which are separately, selectively energized for forward and reverse rotation of rotor 36 through a switch. A terminal cluster (not shown) is provided in housing 22 for connecting the windings to a source of electrical power. Stator 32 is supported in housing 22 by means of its attachment to crankcase 42.

Crankcase 42 has central bearing portion 44 which radially supports upper journal portion 46 of crankshaft 40. Shock mounts 48, attached to crankcase 42 and lower housing portion 26, suspend electric motor assembly 30 and the compressor components within housing 22.

Crankcase 42 defines running gear cavity 50 in which the two eccentric portions of crankshaft 40 and other compressor parts are disposed. Although compressor assembly 20 is a dual cylinder compressor, the scope of the present invention encompasses not only multicylinder compressors, but single cylinder compressors as well. Connecting rods 52 and 54, which may be identical, are respectively connected to pistons 56 and 58 by means of wrist pins 60 which extend through a lateral bore in each piston and wrist end 62 of each connecting rod. Connecting rods 52 and 54 are each connected to crankshaft 40 by rod strap 64 which surrounds the respective eccentric crankpins. Outboard bearing 66 is attached to crankcase 42 by means of bolts 68, and radially supports crankshaft lower journal portion 70. Thrust bearing plate 72 is attached to outboard bearing 66 and axially supports end surface 74 of the crankshaft. Bolts 68 also attach plate 72 to outboard bearing 66.

Lower housing portion 26 defines oil sump 76, in which is disposed oil for lubricating the compressor components. Normally, the oil surface level is above outboard bearing 66 and in contact with lower piston 58. Pistons 56 and 58 respectively reciprocate within cylinders 78 and 80 of equal diameter formed in crankcase 42. Refrigerant gas is drawn into cylinders 78 and 80 at suction pressure and expelled therefrom in a compressed state at discharge pressure through respective, valved suction and discharge ports (not shown) provided in valve plate 82, which covers the cylinder openings. In the ordinary manner, refrigerant gas is drawn through the suction ports of plate 82 and suction valves into the cylinders from suction chamber 84 of head 86. Head 86 is attached to crankcase 42 by means of bolts (not shown) which extend through valve plate 82. Suction chamber 84 is fluidly connected to the interior chamber 88 of compressor assembly 20, which receives low pressure refrigerant gas from the system. Compressed refrigerant gas is forced from the cylinders through the discharge ports of plate 82 and discharge valves into discharge chamber 90 of head 86, from which the discharge pressure gas exits through an elongate, somewhat flexible shock tube (not shown) which extends through the housing wall and provides compressed refrigerant to the system.

Figure 2A:
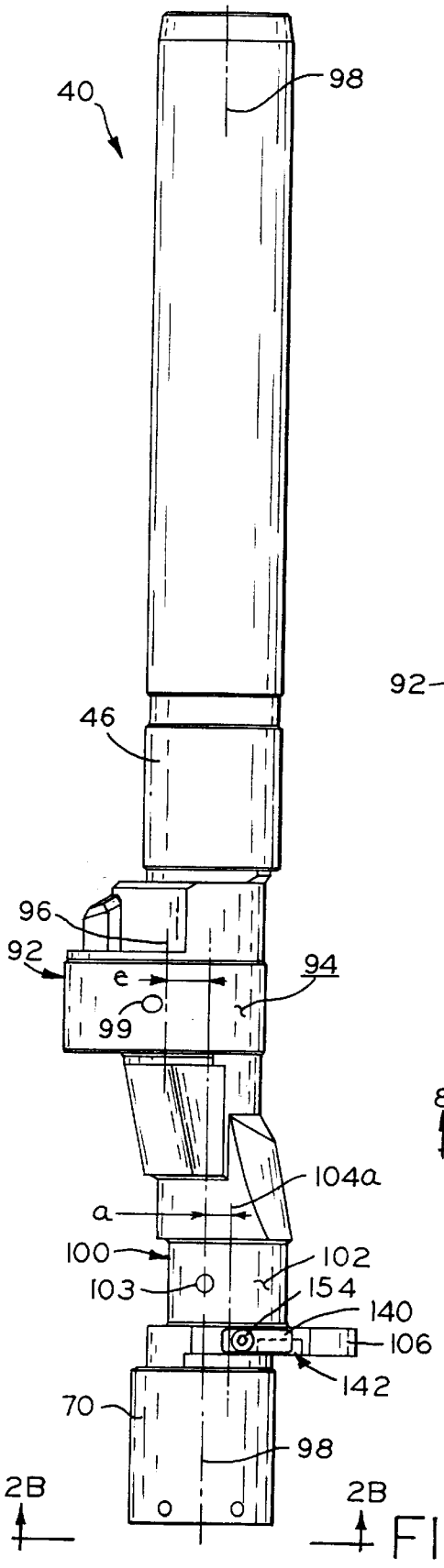
FIG. 2A is a side view of the crankshaft of the compressor of FIG. 1.

Referring to FIG. 2A, it can be seen that upper crankpin 92 of crankshaft 40, which is associated with connecting rod 52 and piston 56, has large cylindrical surface 94 having central axis 96 which is parallel with and offset from crankshaft axis of rotation 98. Radial oil passages 99 extend from radially opposite locations on surface 94 into crankpin 92 and communicate with a longitudinally extending oil passage (not shown) within crankshaft 40. In a well known manner, oil from sump 76 is pumped through the longitudinal passage and provided to the sliding interface between surface 94 and the surrounding interior surface of rod strap 64. Axes 94 and 96 are offset by distance e, the eccentricity of upper crankpin 92, which corresponds to one half the stroke distance of piston 56 in cylinder 78. Lower crankpin 100, which is associated with connecting rod 54 and piston 58, has small cylindrical surface 102 having central axis 104*a* which is parallel with and offset from crankshaft axis of rotation 98. Radial oil passages 103 extend from radially opposite locations on surface 102 into crankpin 100 and communicate the above-mentioned longitudinal oil passage in the crankshaft. As will be described further below, oil which flows through passages 103 flows through conduits formed at the interfaces of the interconnected cam portions to lubricate the outer cylindrical portion of the cam with the interfacing surface of rod strap 64 of connecting rod 54, which surrounds it.

Figure 2B:
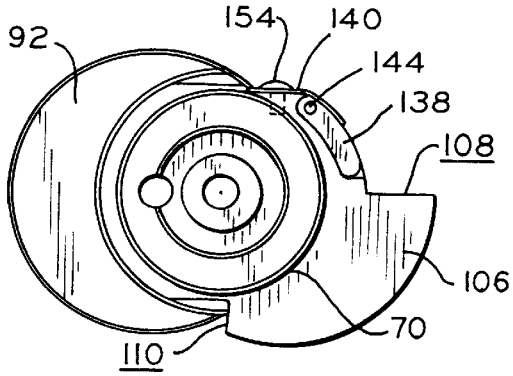
FIG. 2B is an end view of the crankshaft of FIG. 2A.

Axes 98 and 104*a* are offset by distance a, the eccentricity of lower crankpin 100, which is less than distance e. Axes 96, 98 and 104*a* lie in a plane, with axis 104 a located 180° about axis 98 from axis 96 (i.e., completely out of phase with axis 96 as crankshaft 40 rotates about axis 98). Immediately adjacent lower crankpin 100 and formed in crankshaft 40 is flange 106 having, as shown in FIG. 2B, first and second driving surfaces 108 and 110, respectively. Flange 106 is substantially planar and normal to axis 104*a*.

Figure 4:
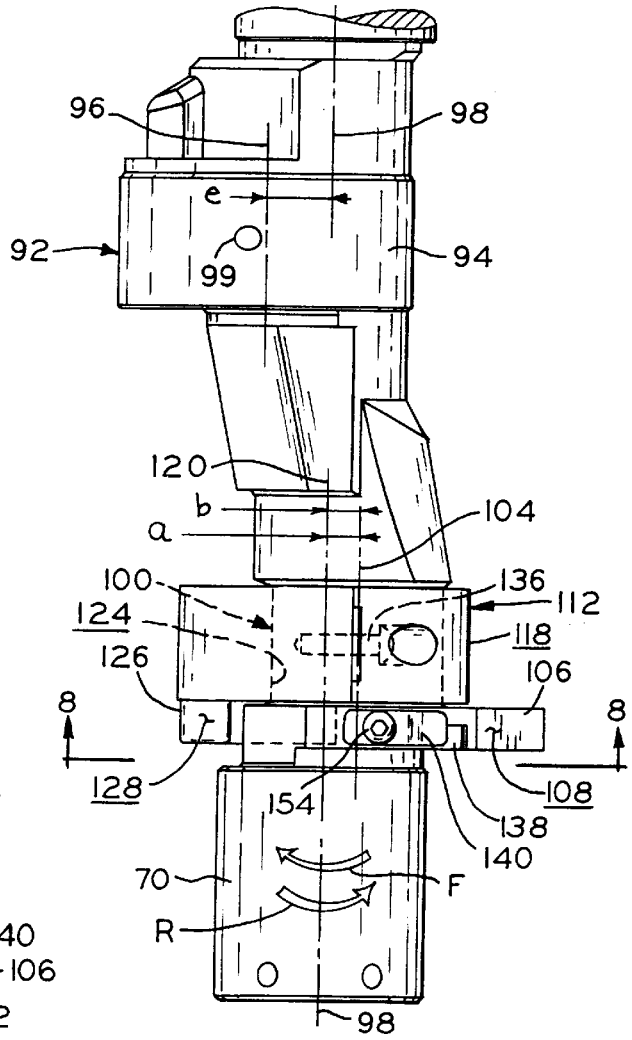
FIG. 4 is an enlarged, fragmentary side view of the crankshaft of FIG. 2A with the cam assembly of FIG. 3 attached thereto.
Figure 3A:
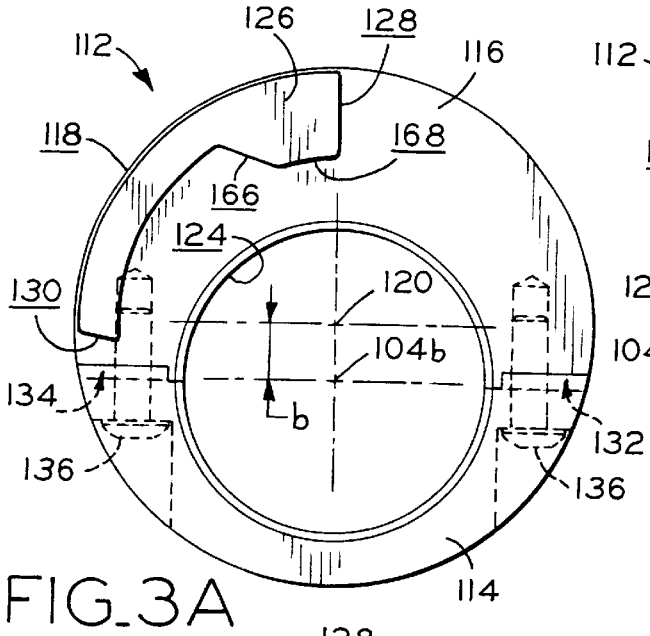
FIG. 3A is a first end view of an embodiment of a cam assembly according to the present invention.
Figure 3B:
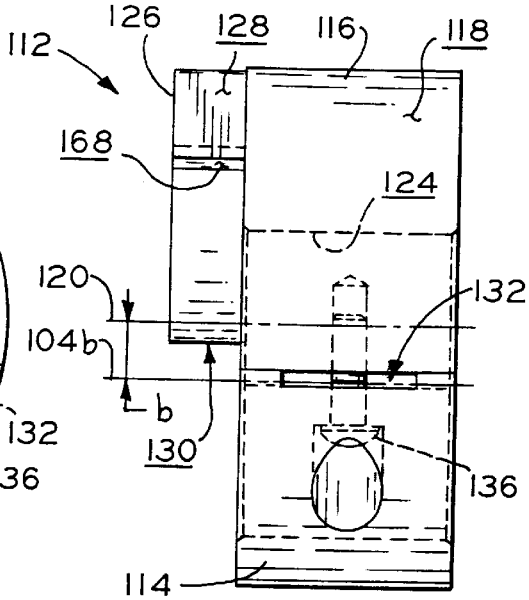
FIG. 3B is a side view of the cam assembly of FIG. 3A.
Figure 3C:
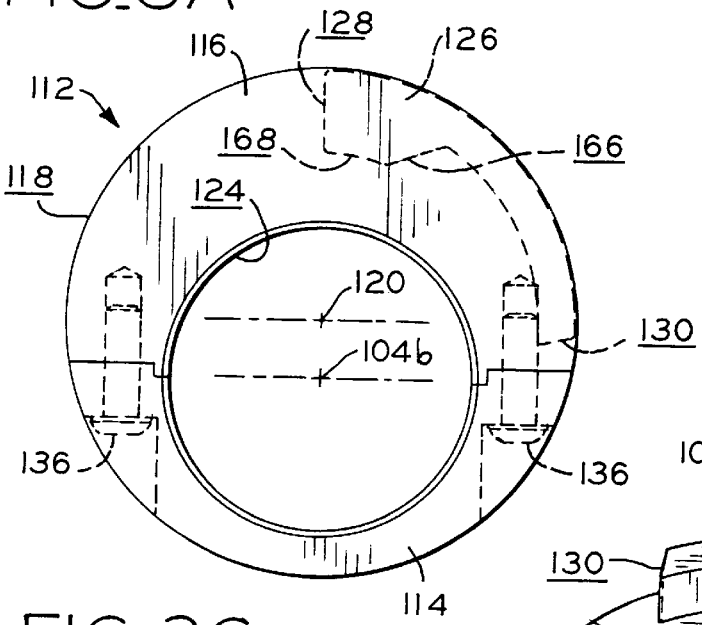
FIG. 3C is a second, opposite end view of the cam assembly of FIG. 3A.
Figure 3D:
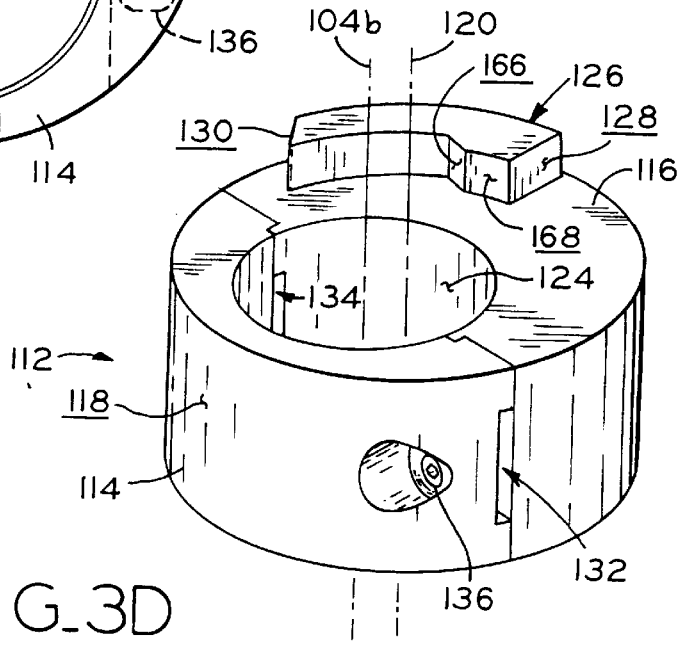
FIG. 3D is a perspective view of the cam assembly of FIGS. 3A–3C.
Figure 5:
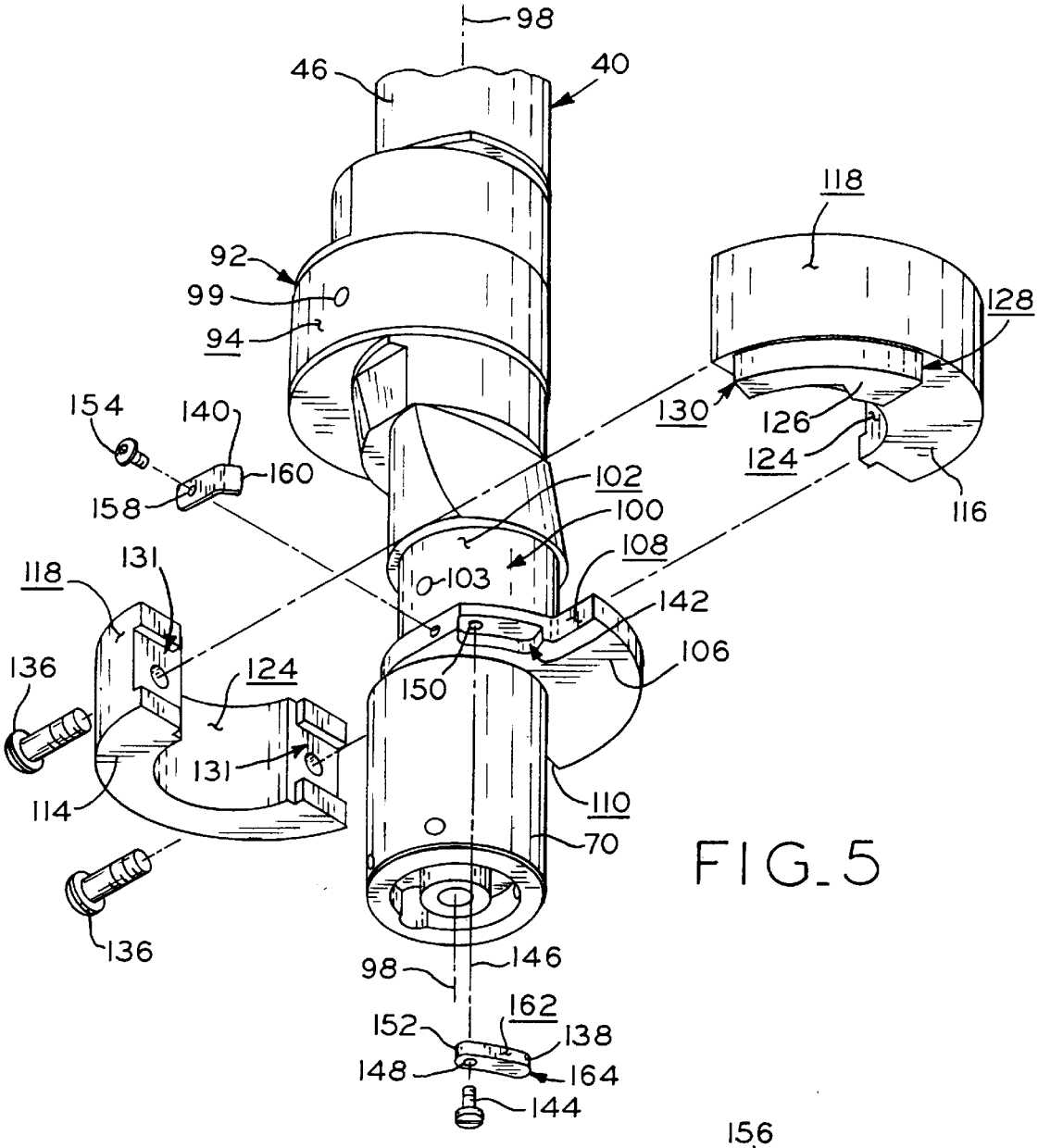
FIG. 5 is an exploded, perspective view of the crankshaft and cam assembly of FIG. 4.
Figure 6:
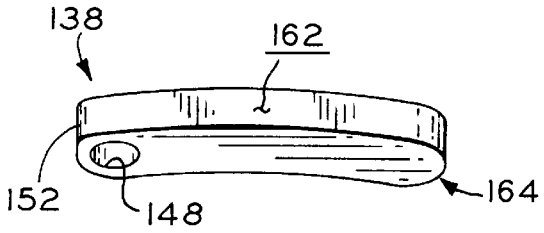
FIG. 6 is a perspective view of an embodiment of a latch member according to the present invention.

Referring now to FIGS. 3A–3D, there is shown an embodiment of a cam assembly according to the present invention. Cam assembly 112 comprises interconnected yoke portion 114 and base portion 116, each of which may be heat treated and nitrided sintered powdered metal, and which are assembled about lower crankpin 100 as shown in FIGS. 4 and 5 and discussed further below. Yoke portion 114 and base portion 116 are a matched pair and are machined together in their assembled form. When fitted together, yoke portion 114 and base portion 116 define cylindrical outer surface 118 having central axis 120 which is parallel to and offset from central axis of interior cylindrical surface 104*b* of cam assembly 112. When cam 112 is assembled to crankshaft 40, axis 104*b* coincides with axis 104*a* of lower crankpin 100 (FIG. 4), and coincident axes 104*a* and 104*b* are commonly referred to as axis 104 hereinbelow. Axes 120 and 104*b* are offset by distance b which, in the shown embodiment of compressor assembly 20, is equivalent to distance a.

Axially extending from one side of cam base portion 116 is generally arcuate driven portion 126. Driven portion 126 axially overlies flange 106, i.e., driven portion 126 and flange 106 both lie in a common plane normal to axis of rotation 98. At opposite circumferential ends of driven portion 126 are first and second driven surfaces 128 and 130, which alternatingly abut first and second driving surfaces 108 and 110 of crankshaft flange 106, respectively, when crankshaft 40 is driven in forward and reverse directions. Hence, cam assembly 112 has a first angular position about lower crankpin 100 when surfaces 108 and 128 abut, during forward rotation of crankshaft 40, and a second angular position about lower crankpin 100 when surfaces 110 and 130 abut, during reverse rotation of crankshaft 40, as will be described further below. Oil conduits 132 and 134 (best seen in FIG. 3D), formed by recesses 131 (FIG. 5) formed in surfaces of yoke portion 114 which interface with base portion 116, extend radially between cylindrical cam surfaces 118 and 124. In each of the first and second angular positions of cam 112 about lower crankpin 100, conduits 132 and 134 are both respectively aligned with one or the other of oil passages 103 provided laterally through the crankpin, thereby providing a supply of oil to the interface between surface 118 and the interfacing surface of the rod strap which surrounds it. A portion of the oil which flows from passages 103 is also supplied to the interface between surfaces 102 and 124.

Referring to FIGS. 3–5, after yoke portion 114 and base portion 116 are assembled together about lower crankpin 100, they are secured together by means of screws 136 which are threadedly received in base portion 116. The heads of screws 136 are recessed within yoke portion 114, below surface 118. Alternatively, yoke portion 114 and base portion 116 may be merely intermitted together and held in there assembled form by virtue of cam 112 being captured in the radial direction by the inner cylindrical surface of rod strap 64 of connecting rod 54 or an intermediate rod strap bearing (not shown), and in the axial direction by adjacent, abutting axial surfaces of crankshaft 40. Further, cam 112 may comprise a single piece having the same overall shape and features as interfitted portions 114 and 116 provide; this embodiment (not shown) would slip axially over crankpin 100 of a crankshaft (not shown) comprising two pieces bolted together at either end of the crankpin. Notably, this alternative, single piece cam embodiment would be provided with cross bores which extend from inner cylindrical cam surface 124 to outer cylindrical cam surface 118, and functionally correspond to conduits 132, 134 described above.

Figures 8A, 8B, 8C:
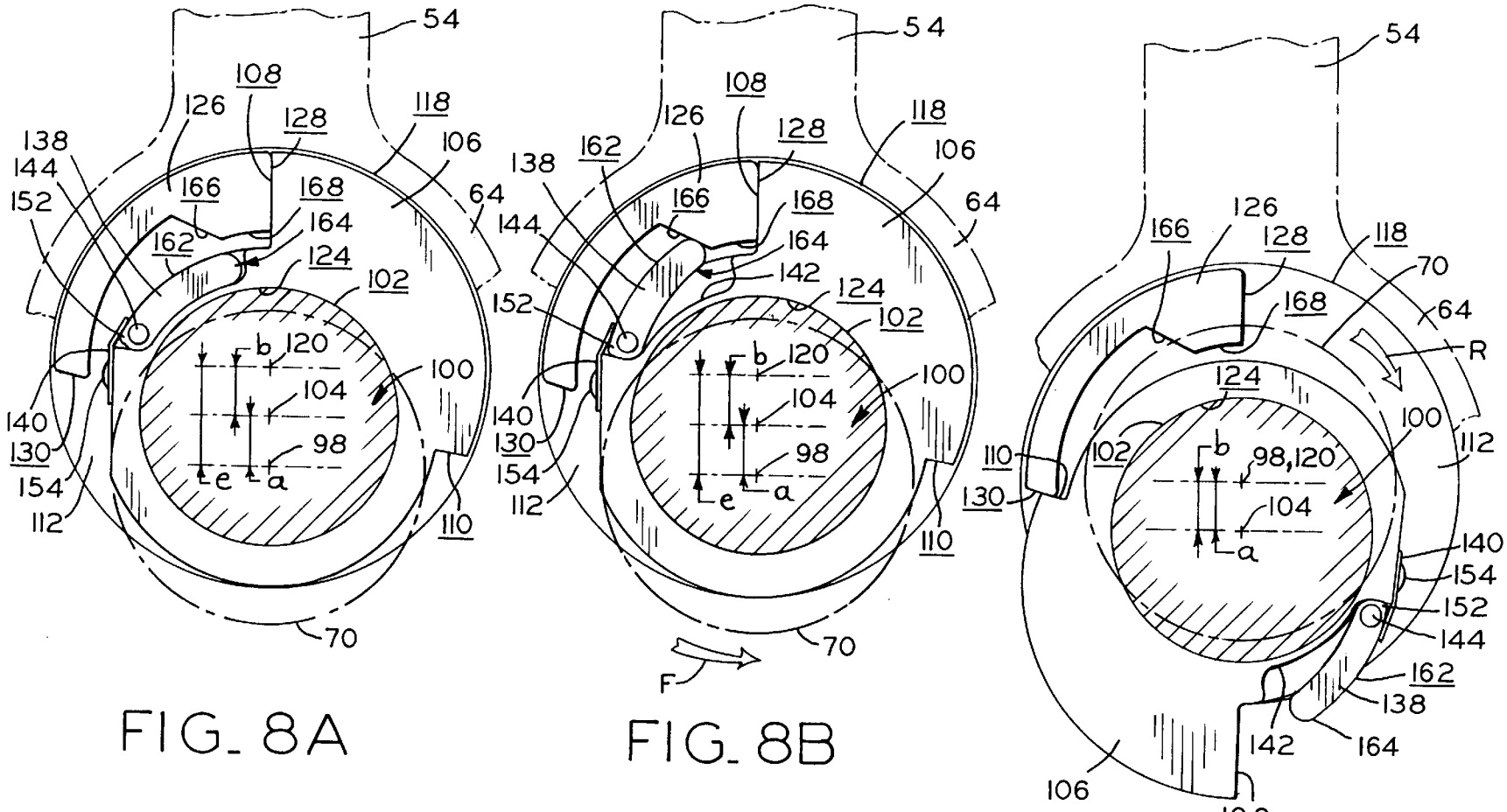
FIG. 8A is a sectional end view of the crankshaft and cam assembly of FIG. 4 along the line 8—8 thereof, showing the cam assembly in a first angular position relative to the crankshaft, the crankshaft and cam unlocked.
FIG. 8B is a sectional end view of the crankshaft and cam assembly of FIG. 8A, showing the cam assembly in its first angular position, the crankshaft and cam locked.
FIG. 8C is a sectional end view of the crankshaft and cam assembly of FIG. 8A, showing the cam assembly in a second angular position.

In FIG. 4 cam assembly 112 is shown in its second angular position, its second driven surface 130 abutting crankshaft flange second driving surface 110, as it would during reverse rotation of crankshaft 40, in the direction of arrow R. In this second angular position, cam central axis 120 is superimposed upon crankshaft axis of rotation 98 and no stroke is imparted to piston 58; in this second cam position, only piston 56 (FIG. 1), which is operatively connected to upper crankpin 92, is stroked. The second angular cam position is also shown in FIG. 8C. Note that in FIGS. 8A–8C, for reference purposes, crankshaft lower journalled portion 70, which is concentric with axis of rotation 98, and connecting rod 54 and its strap 64 are shown in ghosted lines.

Referring again to FIG. 4, should crankshaft 40 be rotated at least 180° about axis 98 in the forward direction indicated by arrow F, first driving surface 108 of flange 106 will be brought into abutment with first driven cam surface 128, and axes 98 and 120 will no longer be superimposed: rather, axes 98 and 120 will lie on opposite sides of and in a plane with axis 104. With surfaces 108 and 128 in abutment, cam 112 is in its first angular position about the crankshaft. Referring to FIG. 8B, it can be seen that in the depicted embodiment, the first angular cam position provides eccentricity e between crankshaft axis of rotation 98 and cam center axis 120 which is equivalent to the sum of distances a and b (i.e., e=a+b). In the first cam position, axis 96 of upper crankpin 92 and axis 120 of cam assembly 112 lie on opposite sides of crankshaft axis of rotation 98, and in a plane therewith. Thus, during forward rotation in the direction of arrow F, axes 96 and 120 are equally eccentric (each having eccentricity e) relative to the crankshaft axis of rotation, and are completely out of phase as crankshaft 40 rotates. It can be readily understood from the above that during forward rotation of crankshaft 40, with cam assembly 112 maintained in its first angular position about lower crankpin 100, pistons 56 and 58 have a common stroke distance (i.e., 2×e) and common displacement, and compressor assembly 20 achieves its maximum displacement during forward crankshaft rotation. During reverse rotation of crankshaft 40, with cam assembly 112 maintained in its second angular position about lower crankpin 100, compressor assembly 20 achieves only a portion (as shown, one half) its maximum displacement. Those skilled in the art will appreciate that, between the two cylinders, different stroke lengths or cylinder bore sizes may also be employed, and it is envisioned that the above described arrangement may be modified to produce a reduced displacement which is greater than or less than one half of the maximum displacement. Further, those skilled in the art will recognize that the present invention may be adapted to single cylinder compressors which have a first displacement when rotated in the forward direction, and a second, different displacement when rotated in reverse direction.

The present invention provides a means for locking cam assembly 112 in its first angular position relative to the crankshaft through the entire cycle of forward rotation. If cam assembly 112 were not continually maintained in its first angular position during forward crankshaft rotation, the reexpansion of the gas in cylinder 80 after piston 58 reaches TDC may force piston 58 away from its TDC position at such a speed that cam assembly 112 may rotate relative to crankpin 100, separating driving and driven surfaces 108 and 128. As described above, the separation of these surfaces would result in their subsequently slamming together as the rotating crankshaft catches up to the cam assembly, causing considerable component stresses and undesirable noise. Further, the slamming together of surfaces 108 and 128 may possibly occur more than once per revolution of the crankshaft.

Components for releaseably locking or latching cam assembly 112 into its full stroke, first angular position about crankshaft 40 are shown in FIG. 5, and include arcuate latch member 138 and leaf spring 140. Latch member 138 may, for example, be made of machined steel or of sintered powdered metal. As shown in FIG. 5, latch member 138 is disposed in recess 142 provided in one axially facing side of flange 106. Fastener 144 extends along axis 146 and through aligned holes 148 and 150 respectively provided in member 138 and flange 106, for attaching member 138 to flange 106. A small diametrical clearance is provided between the generally cylindrical outside surface of fastener 144 and latching member hole 148, thereby allowing member 138 to easily pivot about the fastener and self-adjust its position in recess 142. Fastener 144 may be, for example, a screw or rivet, the head of which maintains the position of member 138 relative to flange 106 along axis 146. Latching member 138 pivots between a retracted position, in which it is seated within recess 142 (FIG. 8A), completely contained within the axially-viewed circumferential profile of flange 106, and an extended position in which it is pivoted away from recess 142 (FIGS. 8B, 8C), and out of the axially-viewed circumferential profile of the flange. The end of member 138 at which hole 148 is located is provided with substantially squared shoulder 152 which abuttingly engages the adjacent end surface of recess 142, thereby limiting the travel of member 138 in its extended position and supporting a compressive load along the length of member 138.

Figure 7:
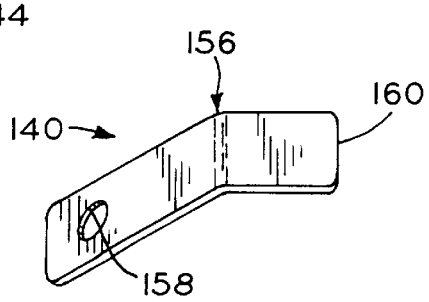
FIG. 7 is a perspective view of an embodiment of a leaf spring by which the latch member of FIG. 6 is biased into an unlatched position.

One end of leaf spring 140 is attached to the circumferential surface of flange 106 adjacent recess 142 by means of fastener 154, which may be a screw or rivet. Spring 140 overlaps the pivotally-attached end of member 138, as best shown in FIGS. 8A–8C. Leaf spring 140, which may be made of spring steel, serves to bias member 138 into its retracted position, and may be plastically deformed at location 156, as shown in FIG. 7, between fastener-receiving 58 hole and end 160 which overlies member 138. Alternatively, spring 140 may be plastically deformed into an arcuate shape which substantially conforms to the shape of outer circumferential surface 162 of member 138. The plastic deformation of the spring better directs the force of the spring against surface 162 for urging member 138 into recess 142.

Latching member 138 is of such mass and configuration that, during forward or reverse rotation of crankshaft 40 about axis 98, its free end 164 is moved out of recess 142 under the influence of centrifugal force, member 138 thus pivoted into its extended position against the biasing force of spring 140, as shown in FIGS. 8B and 8C. When crankshaft 40 is at rest, not rotating in either the forward or the reverse directions respectively indicated by arrows F and R, member 138 is urged into its retracted position by spring 140, as shown in FIG. 8A.

Referring generally to FIGS. 3 and 8, driven portion 126 is provided with locking surface 166 which is located between first and second driven surfaces 128 and 130. Locking surface 166 is generally flat and, in the first cam angular position during forward rotation of crankshaft 40, with member 138 is in its extended position, is engaged by the curved tip of latching member free end 164. With cam assembly 112 in its first angular position, as member 138 is pivoted about fastener 144, the curved tip of its free end 164 defines an arc of travel relative to which surface 166 is substantially tangentially oriented. Thus, with crankshaft 40 rotated in the forward direction (FIG. 8B), member free end 164 swings through an arc about axis 146 and is received into abutting engagement with substantially tangential surface 166. With member 138 in its extended position, shoulder 152 contacts the adjacent end surface of recess 142; a compressive load exerted on free member 164 along the length of member 138 is thus directly transferred to the crankshaft, and is not transferred through fastener 144. The abutting contact between member free end 164 and locking surface 166, which is maintained under the influence of centrifugal force while crankshaft 40 rotates in the direction of arrow F, prevents separation of abutting driving and driven surfaces 108 and 128. During reexpansion of the compressed gases within cylinder 80, after piston 58 passes TDC, latching member 138 experiences a substantially greater state of compression between its opposite ends as it opposes forces which would otherwise separate driving and driven surfaces 108 and 128. At all times member 138 is in its extended position the compressive load exerted on member 138 by locking surface 166 is transferred to flange 106 through shoulder 152.

When switching from forward to reverse directions, or when turning the compressor off during forward crankshaft rotation, surface 166 and the curved tip of member free end 164 disengage once forward rotation of crankshaft 40 slows to a point where the biasing force of spring 140 overcomes the centrifugal force on member 138. When crankshaft rotation in the forward direction slows or ceases, and before crankshaft reverse rotation, spring 140 forces member 138 into its retracted position (FIG. 8A). In its retracted position, outer circumferential surface 164 substantially conforms to the axially-viewed circumferential profile of flange 106. Thus clearance is provided between driven portion 126 and latching member 138. This clearance allows member 138 to pass by adjacent cam driven portion surface 168, which extends between surfaces 108 and 166, as crankshaft 40 is initially rotated from the first cam position. Referring to FIG. 8C, further reverse rotation of the crankshaft brings driving and driven surfaces 110 and 130 into abutting engagement, and the cam then in its second angular position. As in the case of forward rotation, rotation of the crankshaft in the reverse direction urges member 138 into its extended position under the influence of centrifugal force. Latch member 138 provides no function, however, in the second cam position. Similarly, when crankshaft rotation in the reverse direction slows or ceases, spring 140 forces member 138 into its retracted position. Member 138 is thus allowed to pass by adjacent cam driven portion surface 168 without contacting same as crankshaft 40 is rotated back into its first cam position.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reciprocating piston compressor comprising:

at least one cylinder;

a reciprocable piston disposed in said cylinder;

a crankshaft rotatable in both a forward and a reverse direction, said crankshaft having a cylindrical eccentric portion;

a latching member pivotally engaged with said crankshaft;

a cam disposed about said eccentric portion, said piston operatively connected to said cam, said cam rotatable about said crankshaft eccentric portion between a first cam position corresponding to a first piston stroke length during forward rotation of said crankshaft, and a second cam position corresponding to a second piston stroke length during reverse rotation of said crankshaft; and a spring connected to one of said cam and said crankshaft, the position of said latching member influenced by said spring;

wherein, in one of said first and second cam positions, said cam is rotatably locked to said crankshaft eccentric portion by said latching member.

2. The reciprocating piston compressor of claim 1, wherein said latching member has an extended position in which said latching member is engaged with said cam, and a retracted position in which said latching member is out of engagement with said cam.

3. The reciprocating piston compressor of claim 2, wherein, in said extended latching member position, said cam is rotatably locked to said crankshaft.

4. The reciprocating piston compressor of claim 2, wherein said latching member is elongate and has first and second ends, said latching member first end is pivotally engaged with said crankshaft, and in said extended member position said latching member second end is in contact with said cam.

5. The reciprocating piston compressor of claim 4, wherein, in said latching member extended position, said latching member is under a compressive load.

6. The reciprocating piston compressor of claim 4, wherein said latching member is arcuate and in its said retracted position, said latching member conforms to a circumferential profile of a portion of said crankshaft.

7. The reciprocating piston compressor of claim 2, wherein said latching member is urged into its said extended position under the influence of centrifugal force.

8. The reciprocating piston compressor of claim 2, wherein said latching member is biased into its said retracted position by said spring.

9. The reciprocating piston compressor of claim 8, wherein said spring is a leaf spring.

10. The reciprocating piston compressor of claim 9, wherein said leaf spring is elongate and has a first end attached to said crankshaft, said leaf spring in abutting, overlying relationship with said latching member.

11. The reciprocating piston compressor of claim 10, wherein said spring is plastically deformed.

12. The reciprocating piston compressor of claim 2, wherein said cam is provided with first and second driven faces, and said crankshaft comprises a flange having first and second driving faces, said first driven face and said first driving face abutting in said first cam position, said second driven face and said second driving face abutting in said second cam position.

13. The reciprocating piston compressor of claim 12, wherein said cam is provided with a locking surface located between said first and second driven faces, said latching member engaging said locking surface in said latching member extended position.

14. The reciprocating piston compressor of claim 13, wherein, in said first cam position, said locking surface is substantially tangential to an arc of travel defined by said latching member as said latching member is pivoted to its said extended position from its said retracted position.

15. The reciprocating piston compressor of claim 12, wherein said flange is disposed adjacent said crankshaft eccentric portion, said cam is substantially cylindrical and has a central axis, and said cam has an axially projecting driven portion on which said first and second driven faces and said locking surface are located.

16. The reciprocating piston compressor of claim 15, wherein said latching member is pivotally engaged with said flange.

17. The reciprocating piston compressor of claim 1, wherein said cam comprises a plurality of pieces, said cam pieces intermitted about said crankshaft eccentric portion.

18. The reciprocating piston compressor of claim 1, wherein said first and second piston stroke lengths are different.

19. The reciprocating piston compressor of claim 18, wherein one of said first and second piston stroke lengths is zero.

20. A reciprocating piston compressor comprising:

at least one cylinder;

a reciprocable piston disposed in said cylinder;

a crankshaft rotatable in both a forward and a reverse direction, said crankshaft having a cylindrical eccentric portion;

a latching member;

a cam disposed about said crankshaft eccentric portion, said piston operatively connected to said cam, said cam rotatable about said crankshaft eccentric portion between a first cam position corresponding to a first piston stroke length during forward rotation of said crankshaft, and a second cam position corresponding to a second piston stroke length during reverse rotation of said crankshaft; and means for placing said latching member under compression between said cam and said crankshaft in one of said first and second cam positions, thereby rotatably locking said cam to said crankshaft.

* * * * *

UNITED STATES PATENT AND TRADEMARK OFFICE

CERTIFICATE OF CORRECTION

PATENT NO. : 6,190,137 B1
DATED : March 30, 2001
INVENTOR(S) : Elizabeth A. Robbins et al.

It is certified that error appears in the above-identified patent and that said Letters Patent is hereby corrected as shown below:

Claim 17, column 10,
Line 21, delete " intermitted" and substitute therefor -- interfitted --

Signed and Sealed this

Fourth Day of September, 2001

*Attest:*

Nicholas P. Godici

*Attesting Officer*

NICHOLAS P. GODICI
*Acting Director of the United States Patent and Trademark Office*